US006027291A

United States Patent [19]

Sain et al.

[11] Patent Number: 6,027,291

[45] Date of Patent: Feb. 22, 2000

[54] STACKING APPARATUS FOR CONTAINERS

[75] Inventors: Bernard S. Sain, Jacksonville, Fla.; Dudley E. Loveland, Jackson, N.J.

[73] Assignee: International Transport Logistics, Inc., Jacksonville, Fla.

[21] Appl. No.: 08/955,948

[22] Filed: Oct. 22, 1997

[51] Int. Cl.[7] ..... B60P 7/13

[52] U.S. Cl. ..... 410/35; 410/34; 410/46; 410/77; 410/82

[58] Field of Search ..... 410/34, 35, 82, 410/46, 77, 78, 68; 24/287; 206/503, 509; 220/1.5, 4.26, 4.27

[56] References Cited

U.S. PATENT DOCUMENTS

| | | | |
|---|---|---|---|
| 3,367,615 | 2/1968 | Turpen | 410/82 |
| 3,386,600 | 6/1968 | Betjemann . | |
| 3,543,951 | 12/1970 | Marvin . | |
| 3,646,609 | 2/1972 | Bodenheimer . | |
| 3,734,308 | 5/1973 | Pasternack | 410/80 |
| 4,108,326 | 8/1978 | Bertolli . | |
| 4,221,515 | 9/1980 | Brown et al. | 410/32 |
| 4,349,108 | 9/1982 | Sharpe . | |
| 4,648,764 | 3/1987 | Pavlick | 410/77 |
| 5,183,375 | 2/1993 | Fenton et al. | 410/35 |
| 5,193,253 | 3/1993 | Janke et al. | 24/287 |

FOREIGN PATENT DOCUMENTS

| | | | |
|---|---|---|---|
| 3925188 | 10/1990 | Germany | 220/1.5 |

*Primary Examiner*—Stephen T. Gordon
*Attorney, Agent, or Firm*—Foley & Lardner

[57] ABSTRACT

An apparatus, for securely vertically stacking at least one row of side-by-side upper cargo containers with respect to at least one row of side-by-side lower cargo containers, includes at least two rails. Each of these rails has upper and lower mounting fixtures connected thereto so that the rail can be juxtaposed between two rows of upper and lower stacked containers. One of the upper or the lower containers is wider than the other of the upper or the lower containers.

17 Claims, 5 Drawing Sheets

STACKING APPARATUS FOR CONTAINERS

BACKGROUND

Cargo containers for overland and marine freight handling are produced in various standard sizes, including, among others, containers of 20, 40, 45, 48 and 53 feet lengths, as well as 96 inch and 102 inch widths.

These containers are typically provided with mounting fixtures used in securing the containers with respect to various vehicles or other cargo containers. The mounting fixtures are positioned in standard arrangements on both the top and bottom of the containers. For example, a conventional I.S.O. cargo container is 40 feet long and 96 inches wide, and includes mounting fixtures at each of the eight corners of the container.

It is typical to transport together many containers having various sizes. Different techniques for handling cargo containers having different lengths are disclosed, for example, in U.S. Pat. No. 3,646,609 to Bodenheimer, U.S. Pat. No. 4,108,326 to Bertolini, and U.S. Pat. No. 5,183,375 to Fenton et al. (hereinafter "Fenton").

Bodenheimer discloses support points at intermediate positions along the length of cargo containers. The support points are spaced apart to match the mounting fixtures of shorter cargo containers. When stacking cargo containers of different lengths, the support points of a longer cargo container are vertically aligned with the mounting fixtures of a shorter cargo container. A disadvantage of Bodenheimer is that including support points in a wider cargo container to match the mounting fixtures of a narrower cargo container would obstruct the interior capacity of the wider cargo container. Further, because the location of support points is a function of the relative numbers of side-by-side wider and narrower containers, a large number of interior support points would be required inside both wider and narrower cargo containers to ensure each mounting fixture could be aligned with a support point.

Bertolini discloses attaching an adapter frame to the ends of shorter cargo containers to provide mounting fixtures matching longer cargo containers. A disadvantage of Bertolini is the lack of any provision for stacking cargo containers having different widths. As with Bodenheimer, the position of mounting fixtures is dependent on the relative numbers of side-by-side wider and narrower cargo containers. Further, Bertolini fails to disclose laterally offsetting the outboard mounting points of the adapter frames to accommodate the cargo containers of different widths.

Fenton also discloses an adapter frame for supporting one or two shorter cargo containers on a relatively longer cargo container. Fenton is directed to a single column of stacked cargo containers having the same width to be used on a railway car.

Typically, additional lashing (e.g. cables) is required to compensate for the inability to align and connect all the mounting fixtures of stacked cargo containers having different widths. The additional lashing is both time consuming and expensive to fit and remove.

There is a need for a simple container stacking apparatus that can stack containers having different dimensions, without any of above-noted drawbacks. The present invention meets this need.

SUMMARY

The present invention relates generally to an apparatus for vertically stacking elongated cargo containers having different dimensions, e.g., widths or lengths or both. The present container stacking apparatus can vertically support first cargo containers having a first width in a stacked relationship with second cargo containers having a second width, which is different from the first width.

According to one aspect of the invention, the stacking apparatus is for stacking elongated first containers on top of generally elongated second containers having a different width than the first containers. The stacking apparatus comprises at least two elongated rails. Each rail has a plurality of first mounting fixtures for aligning and releasably connecting the rail to the first containers and has a plurality of second mounting fixtures for aligning and releasably connecting the rail to the second containers.

The first mounting fixtures are aligned in a row generally perpendicularly to the longitudinal direction of the first containers and the second mounting fixtures are aligned in a row generally perpendicularly to the longitudinal direction of the second containers. The two rails are spaced apart in the longitudinal direction of the first and second containers.

According to another aspect of the invention, the stacking apparatus is for stacking side-by-side generally wider containers on top of side-by-side generally narrower containers. The stacking apparatus comprises two elongated rails each having a plurality of first mounting fixtures for aligning and releasably connecting the rail to the wider containers and a plurality of second mounting fixtures for aligning and releasably connecting the rail to the narrower containers.

The first mounting fixtures are aligned in a row generally parallel to the width direction of the wider containers and the second mounting fixtures are aligned in a row generally parallel to the width direction of the narrower containers. The two rails are spaced apart in a direction perpendicular to the width direction of the wider or narrower containers.

According to further aspect of the invention, a pair of the first mounting fixtures can secure one of the first or wider, e.g., upper, containers with respect to each of the rails. Adjacent pairs of the first mounting fixtures of each of the rails are spaced apart by a first distance along the longitudinal direction thereof. A pair of the second mounting fixtures can secure one of the second or narrower, e.g., lower, container with respect to each rail. Adjacent pairs of the second mounting fixtures of each of the two rails are spaced apart by a second distance along the longitudinal direction thereof.

The second distance is different from the first distance, which can be either smaller or larger than the second distance. The first and second spacing distances are related to the widths of the respective upper and lower containers. If the upper containers have a wider width than that of the lower containers, the first spacing distance is greater than the second spacing distance, and vice versa.

Each of the two rails can further include at least one transverse projection extending laterally therefrom and engaging a bottom surface of at least one of the upper containers or a top surface of at least one of the lower containers or both. In particular, the transverse projection can extend between the adjacent pairs of the second mounting fixtures.

The transverse projection can be adapted to engage the bottom surface of one of the upper containers and the top surfaces of two adjacent lower containers.

The first mounting fixtures can be arranged along a first surface of the rail and the second mounting fixtures can be arranged along a second surface of the rail, where the first and second surfaces are positioned vertically opposite.

Each of the first and second mounting fixtures preferably comprises a lock for releasably coupling the upper and lower containers to the rail. The lock is selectively expandable to lock with a recess formed in the containers.

The two rails can be mirror images of one another so that the transverse projections of the two rails extend toward each other. The two rails are spaced apart not greater than the shortest length of the upper and lower containers.

According to another aspect of the invention, two transverse members connect the two rails.

According to another aspect of the invention is the rail per se as described above, and for stacking side-by-side upper containers on top of side-by-side lower containers having a width different from that of the first containers. In particular, the first mounting fixtures are mounted to a first surface of the rail for aligning and releasably connecting the rail to the upper containers parallel to the width direction of the upper containers. The second mounting fixtures are similarly mounted to a second surface of the rail for aligning and releasably connecting the rail to the lower containers parallel to the width direction of the lower containers. The first and second surfaces are vertically spaced.

The first mounting fixtures extend in a first direction and the second mounting fixtures extend in a second direction, which is opposite the first direction.

BRIEF DESCRIPTION OF THE DRAWINGS

These and other features, aspects, and advantages of the present invention will become more apparent from the following description, appended claims, and accompanying exemplary drawings, which illustrate presently preferred embodiments of the invention.

DETAILED DESCRIPTION OF THE PREFERRED EMBODIMENTS

Figure 1:
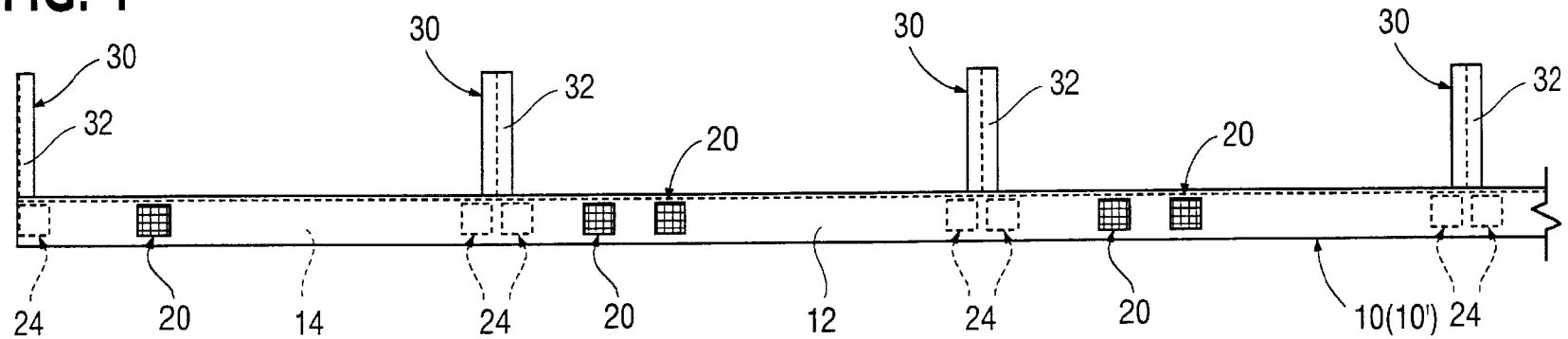
FIG. 1 shows a top elevational view of a stacking apparatus according to a first embodiment of the present invention.
Figure 2:
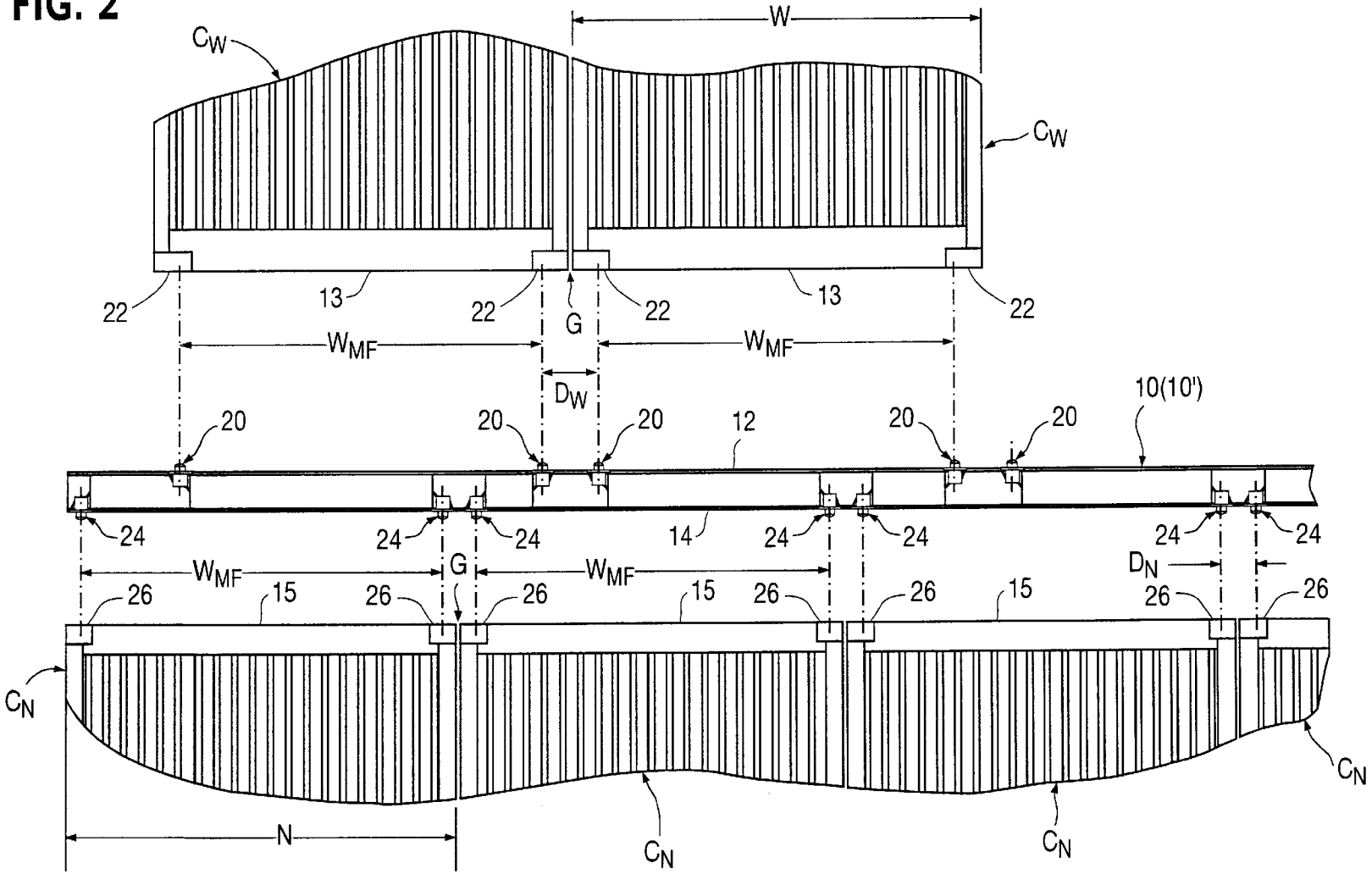
FIG. 2 shows an exploded front view of the stacking apparatus illustrated in FIG. 1 interposed between cargo containers having different widths.
Figure 3:
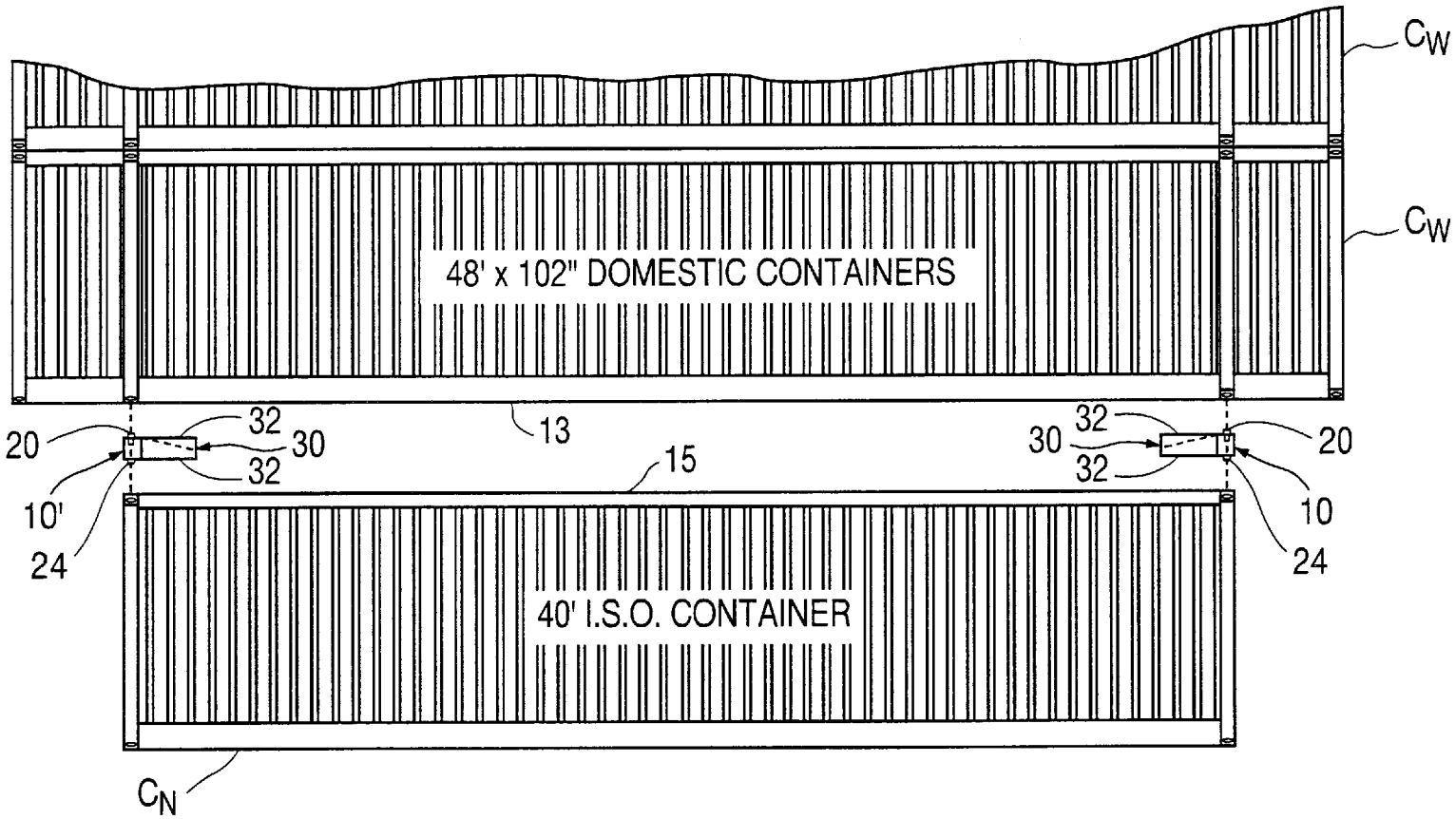
FIG. 3 shows an exploded side view of the stacking apparatus illustrated in FIG. 1 interposed between cargo containers having different lengths.

A first embodiment of the stacking apparatus according to the present invention is illustrated in FIGS. 1–3. According to the first embodiment, the stacking apparatus includes at least two elongated rails 10, 10'. In the embodiment shown, the stacking apparatus includes two rails 10 and 10' for stacking cargo containers of two different widths, although containers having more than two different widths can be stacked by correspondingly arranging the rails. In this embodiment, the containers of the same layer have the same width, although different widths within the same layer can also be contemplated. Moreover, additional intermediate rails can be included between the two rails 10 and 10'.

The two rails 10 and 10' are mirror images of one another, but are otherwise identical. Each of these rails 10 and 10' includes a top surface 12 for supporting the bottom surfaces 13 of the stacked upper cargo containers and a bottom surface 14 for supporting the top surfaces 15 of the stacked lower cargo containers. The rail 10, 10' is interposed between stacked cargo containers of different widths and longitudinally extends along their widths.

In the embodiment shown in FIGS. 1–3, the top surface 12 confronts or engages upper, relatively wider cargo containers (hereafter "wide containers") $C_W$ and the bottom surface 14 confronts or engages lower, relatively narrower cargo containers (hereafter "narrow containers") $C_N$. See FIG. 2. But according to the invention, the rail 10, 10' can be reversed so that the wide containers $C_W$ are situated below the narrow containers $C_N$. In this situation, the surface 14 of the rail 10, 10' would become the top and the surface 12 of the rail 10, 10' would become the bottom.

The length of the rail 10, 10' is selected depending on the desired number of side-by-side cargo containers $C_W$, $C_N$ in each layer. Therefore, more or less than the illustrated numbers of cargo containers $C_W$, $C_N$ can be secured relatively together using the present stacking apparatus.

A plurality of first mounting fixtures 20 are formed on the rail 10, 10' with respect to the top surface 12. The first mounting fixtures 20 are located along the length of the rail 10, 10' to align with corresponding mounting fixtures 22 on each of the wide containers $C_W$. Although a pair of first mounting fixtures 20 are illustrated corresponding to a pair of mounting fixtures 22 on each wide container $C_W$, more than two corresponding mounting fixtures 20, 22 can be used for securing a wide container $C_W$ to the rail 10, 10'.

A plurality of second mounting fixtures 24 are formed with respect to the bottom surface 14. The second mounting fixtures 24 are located along the length of the rail 10, 10' to align with corresponding mounting fixtures 26 on each of the narrow containers $C_N$. Similarly to the first mounting fixtures 20, although a pair of second mounting fixtures 24 are illustrated corresponding to a pair of mounting fixtures 26 on each narrow container $C_N$, more than two corresponding mounting fixtures 24, 26 can be used for securing a narrow container $C_N$ to the rail 10, 10'.

Each of the rails 10, 10' shown in FIGS. 1–3 uses two mounting fixtures 20, 24 for mounting a single container $C_W$, $C_N$, respectively. The spacing $D_W$ between each pairs of the first mounting fixtures 20 for the wide containers $C_W$ is the same for containers having the same width within the same layer. Likewise, the spacing $D_N$ between each pairs of the second mounting fixtures 24 is the same for containers having the same width within the same layer.

The typical cargo containers use same spacing $W_{MF}$ between each pair of mounting fixtures 20, 24, even though the containers have different dimensions. See FIG. 2. Since the spacing $W_{MF}$ between the mounting fixtures pairs are the same for both the wide containers $C_W$ and the narrow containers $C_N$, the spacing distance $D_W$ between adjacent pairs of the first mounting fixtures 20 is related to the width W of the wide containers $C_W$ and the gap G between two adjacent wide containers $C_W$.

Similarly, the spacing distance $D_N$, between adjacent pairs of the second mounting fixtures 24 is related to the width N of the narrow containers $C_N$ and the gap between two adjacent narrow containers $C_N$.

The spacing distances $D_W$, $D_N$ thus differ because the widths W, N are different for the cargo containers $C_W$, $C_N$, respectively, while the same mounting fixture spacing $W_{MF}$ is used for both the first and second mounting fixtures.

It is desirable to space the adjacent containers at a minimal distance to maximize the container density and to facilitate any relative displacement of side-by-side containers during loading and unloading and to account for any cargo size irregularities. In this respect, the spacing distance $D_W$, $D_N$ can be set less than 3% of the width W, N of each cargo container $C_N$, $C_W$, and more preferably approximately 1%.

The rail 10, 10' can include at least one lateral projection 30 extending transversely therefrom to stabilize the rail 10, 10' and thus better secure it to the containers. The preferred embodiment shows four of these projections 30, each extending from the rail 10, 10' between adjacent pairs of the second mounting fixtures 24. As shown, each projection 30 includes a top pad 32 for engaging the bottom surface 13 of the wide container $C_W$ and a bottom pad 34 for engaging the top surface 15 of both of two adjacent narrow cargo containers $C_N$. That is, because the projection 30 extends between the adjacent pairs of the second mounting fixtures, the projection engages two adjacent narrow containers $C_N$ over the gap G.

As shown in FIG. 3, the rail 10' is interposed between the cargo containers $C_W$, $C_N$ at an opposite longitudinal end of the cargo containers $C_W$, $C_N$ from the rail 10. FIG. 3 also shows cargo containers $C_W$, $C_N$ having relatively different lengths as well as relatively different widths. The present invention, however, can also can be contemplated for cargo containers $C_W$, $C_N$ having the same relative length and different relative widths, or having the same length and width. Where the containers are long, one or more intermediate rails can be interposed between the two outermost rails 10 and 10'. Either of the two rails 10 and 10' can be used as an intermediate rail. The intermediate rail, however, can further include additional lateral projections 30 that extend in the opposite direction (not shown).

Figure 4:
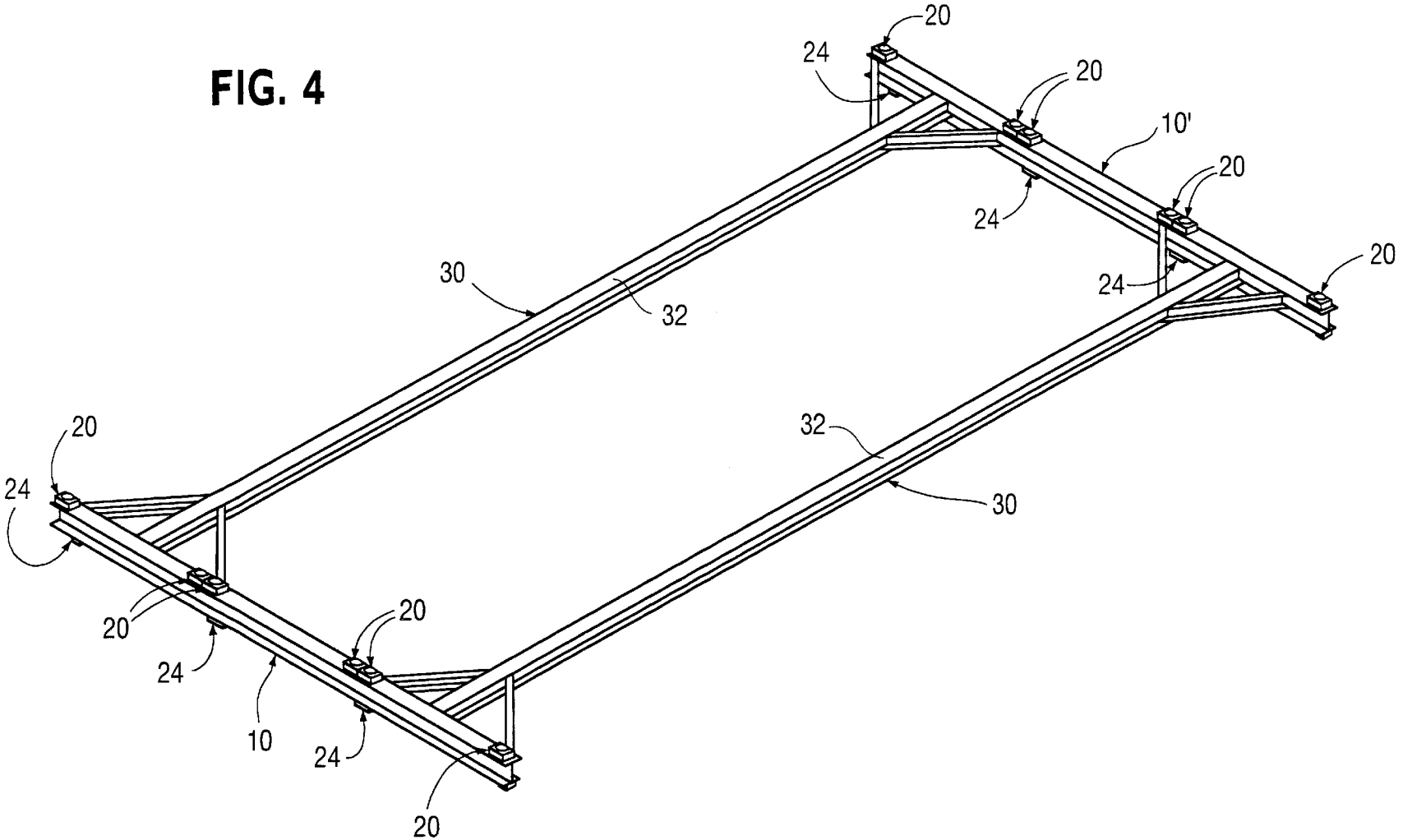
FIG. 4 shows a perspective view of a stacking apparatus according to an alternate embodiment of the present invention.

FIG. 4 illustrates an alternate embodiment of the present invention. In this embodiment, two rails 10 and 10' are linked together with transverse projections or members 30 to one another. This embodiment shows two transverse members 30 connecting the two rails 10 and 10'. Otherwise the features of this alternate embodiment are substantially the same as those of the embodiment illustrated in FIGS. 1–3.

Figure 5:
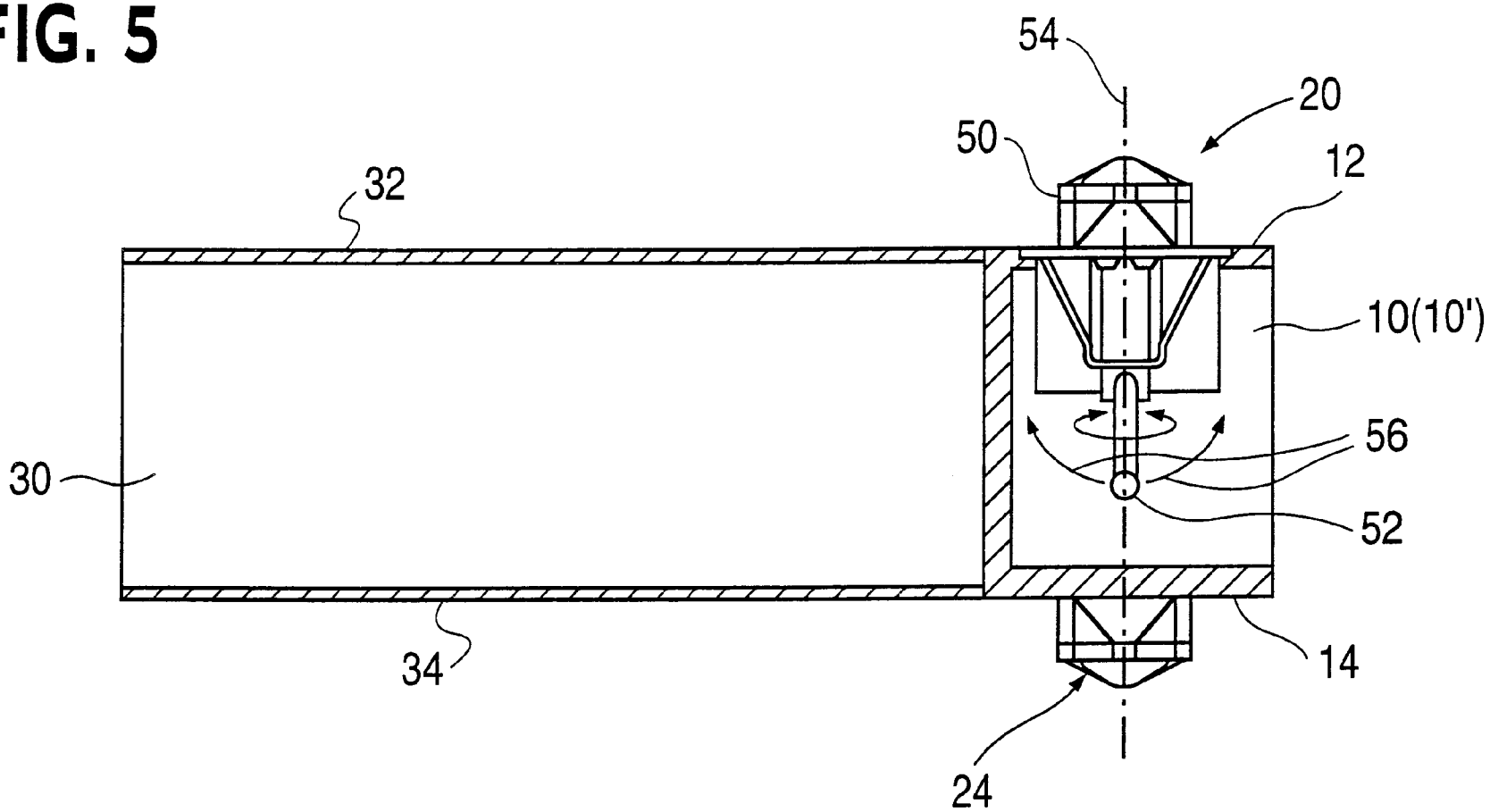
FIG. 5 is a detail view of a mounting fixture according to the present invention.

FIG. 5 shows a preferred mounting fixture according to the present invention. Each of the mounting fixtures 20 and 24 may be as shown in FIG. 5, or different as is necessary to mate with and lock to the containers' mounting fixtures 22 and 26. Each of the mounting fixtures 20 and 24 shown in FIG. 5 is identical and comprises an expandable male connector portion 50. An actuator handle for expanding the male connector portion 50 is located in a recessed cavity of the rail 10, 10'. In practice, the male connector portion 50 of the mounting fixtures 20 and 24, in its unexpanded state, is aligned and inserted into the container's corresponding mounting recess or female portion (not shown). The handle 52 is twisted or rotated about an axis of rotation 54 to expand the male portion 50 within the female portion of mounting fixture 22, 26 and interlock them. To ensure that the container $C_W$, $C_N$ is securely retained with respect to the rail 10, 10', the handle 52 is folded in a direction shown by arrows 56 to lock the mounting fixture 20, 24 with respect to the mounting fixture 22, 26, respectively. To release the lock, the handle 52 is rotated in either of the directions 56 and rotated in the opposite direction about the axis 54 to contract the male portion. Other equivalent locking arrangements can be used for releasably retraining the containers with respect to the rails 10 and 10'.

According to the invention, the rail 10, 10' has differently spaced mounting fixtures 20, 24 on opposite surfaces of the rail. This allows stacking of containers of different widths and/or length in a stacked relationship without or minimal additional supports, such as lashings.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

What is claimed is:

1. An apparatus for stacking elongated first containers on top of generally elongated second container having a different width than the first containers, the stacking apparatus comprising:

at least two elongated rails each having:

a plurality of first mounting fixtures for aligning and releasably connecting the rail to the first containers; and a plurality of second mounting fixtures for aligning and releasably connecting the rail to the second containers, wherein the first mounting fixtures are aligned in a row generally perpendicularly to a longitudinal direction of the first containers and the second mounting fixtures are aligned in a row generally perpendicularly to a longitudinal direction of the second containers, wherein the two rails are spaced apart in the longitudinal direction of the first and second containers, wherein a pair of the first mounting fixtures are adapted to secure one of the first containers with respect to each of the two rails, and adjacent pairs of the first mounting fixtures of each of the two rails are spaced apart by a first distance along a longitudinal direction thereof, wherein a pair of the second mounting fixtures are adapted to secure one of the second containers with respect to each of the two rails, and adjacent pairs of the second mounting fixtures of each of the two rails are spaced apart by a second distance along a longitudinal direction thereof, which second distance is different from the first distance, and wherein the first spacing distance is related to the width of the first containers and the second distance is related to the width of the second containers.

2. The stacking apparatus according to claim 1, wherein the first mounting fixtures are arranged along a first surface of the respective rail and the second mounting fixtures are arranged along a second surface of the respective rail, the first and second surfaces being positioned vertically opposite.

3. The stacking apparatus according to claim 1, wherein each of the two rails further includes at least one transverse projection extending laterally therefrom and engaging a bottom surface of at least one of the first containers or a top surface of at least one of the second containers or both.

4. The stacking apparatus according to claim 3, wherein the transverse projection extends between the adjacent pairs of the second mounting fixtures.

5. The stacking apparatus according to claim 4, wherein the transverse projection is adapted to engage the bottom surface of one of the first containers and the top surfaces of two adjacent second containers.

6. The stacking apparatus according to claim 5, wherein the first containers have a wider width than that of the second containers.

7. The stacking apparatus according to claim 1, further comprising two transverse members connecting the two rails.

8. The stacking apparatus according to claim 1, wherein each of the first and second mounting fixtures comprises a lock for releasably coupling the first and second containers to the respective rail.

9. The stacking apparatus according to claim 8, wherein the lock is selectively expandable to lock with a recess formed in the first and second containers.

10. The stacking apparatus according to claim 1, wherein each of the rails further includes at least one transverse projection extending therefrom.

11. The stacking apparatus according to claim 10, wherein the two rails are mirror images of one another so that the transverse projections of the two rails extend toward each other.

12. The stacking apparatus according to claim 11, wherein the two rails are spaced apart not greater than the shortest length of the first or second containers.

13. An apparatus for stacking side-by-side generally wider containers on top of side-by-side generally narrower containers, comprising:

two elongated rails each having:

a plurality of first mounting fixtures for aligning and releasably connecting the rail to the wider containers; and a plurality of second mounting fixtures for aligning and releasably connecting the rail to the narrower containers, wherein the first mounting fixtures are aligned in a row generally parallel to a width direction of the wider containers and the second mounting fixtures are aligned in a row generally parallel to a width direction of the narrower containers, wherein the two rails are spaced apart in a direction perpendicular to the width direction of the wider or narrower containers, wherein a pair of the first mounting fixtures are adapted to secure one of the wider containers with respect to each of the two rails, and adjacent pairs of the first mounting fixtures of each of the two rails are spaced apart by a first distance along a longitudinal direction thereof, wherein a pair of the second mounting fixtures are adapted to secure one of the narrower containers with respect to each of the two rails, and adjacent pairs of the second mounting fixtures of each of the two rails are spaced apart by a second distance along a longitudinal direction thereof, which second distance is narrower than the first distance, and wherein the first spacing distance is related to the width of the wider containers and the second distance is related to the width of the narrower containers.

14. The stacking apparatus according to claim 13, wherein each of the rails further includes at least one transverse projection extending therefrom.

15. The stacking apparatus according to claim 14, wherein the two rails are mirror images of one another so that the transverse projections of the two rails extend toward each other.

16. The stacking apparatus according to claim 15, wherein the two rails are spaced apart not greater than the shortest length of the wider or narrower containers.

17. The stacking apparatus according to claim 13, further comprising two transverse members connecting the two rails.

* * * * *